US010719027B1

(12) United States Patent
Kano et al.

(10) Patent No.: US 10,719,027 B1
(45) Date of Patent: Jul. 21, 2020

(54) CLEANING BODY, CLEANING DEVICE, AND IMAGE FORMING APPARATUS

(71) Applicant: FUJI XEROX CO., LTD., Tokyo (JP)

(72) Inventors: Fuyuki Kano, Kanagawa (JP); Yasuhiko Kinuta, Kanagawa (JP); Akihiro Nonaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/520,644

(22) Filed: Jul. 24, 2019

(51) Int. Cl.
*G03G 21/00* (2006.01)
*G03G 15/02* (2006.01)
*G03G 21/16* (2006.01)

(52) U.S. Cl.
CPC ..... *G03G 15/0225* (2013.01); *G03G 21/169* (2013.01)

(58) Field of Classification Search
CPC ..... G03G 15/0225; G03G 21/169; G03G 21/0058
See application file for complete search history.

(56) References Cited

U.S. PATENT DOCUMENTS

| | | | | |
|---|---|---|---|---|
| 8,538,287 | B2 | 9/2013 | Kawai | |
| 9,639,020 | B1 * | 5/2017 | Kano | G03G 15/0225 |
| 2012/0076528 | A1 * | 3/2012 | Nonaka | G03G 15/0258 399/100 |
| 2012/0082475 | A1 * | 4/2012 | Kawai | G03G 15/0225 399/100 |
| 2016/0378013 | A1 * | 12/2016 | Kano | G03G 15/0225 399/100 |
| 2017/0212468 | A1 * | 7/2017 | Rokutan | G03G 15/0225 |
| 2018/0210363 | A1 * | 7/2018 | Kano | G03G 15/0225 |

FOREIGN PATENT DOCUMENTS

| | | |
|---|---|---|
| JP | 2-272594 A | 11/1990 |
| JP | 2012-14011 A | 1/2012 |

* cited by examiner

*Primary Examiner* — Sophia S Chen
(74) *Attorney, Agent, or Firm* — Sughru Mion, PLLC

(57) ABSTRACT

A cleaning body includes a shaft and an elastic layer disposed by being spirally wound around an outer circumferential surface of the shaft from one end to the other end of the shaft, wherein a relationship between line roughness of a protruding portion formed at an end portion of the elastic layer in a width direction (RaE) and line roughness of a center portion of the elastic layer in the width direction (RaV) satisfies 5≤RaE/RaV.

7 Claims, 11 Drawing Sheets

W = the average of the length of each side of the measured triangular area is set as the width W of the nodal section of the foam cell wall surface of an elastic layer.

CLEANING BODY, CLEANING DEVICE, AND IMAGE FORMING APPARATUS

CROSS-REFERENCE TO RELATED APPLICATIONS

This application is based on and claims priority under 35 USC 119 from Japanese Patent Application No. 2019-052982 filed on Mar. 20, 2019.

BACKGROUND

(i) Technical Field

The present invention relates to a cleaning body, a cleaning device, and an image forming apparatus.

(ii) Related Art

JP-A-02-272594 discloses an image forming apparatus including an image holding member and a contact-type elastic charging unit for applying a bias voltage to the image holding member and/or a transfer material by pressure-contacting the image bearing member, in which the cleaning unit formed of a sponge material comes in contact with the elastic charging unit.

JP-A-2012-014011 discloses a clean member for an image forming apparatus including a core and an elastic layer disposed by spirally winding a strip-shaped elastic member around an outer circumferential surface of the core, in which when a thickness of a center portion of the elastic layer in a state of being wound around the outer circumferential surface of the core in a spiral width direction is set as t (mm), and a thickness of the strip-shaped elastic member before being wound around the outer circumferential surface of the core in a width direction is set as T (mm), the following conditional expression (A1) is satisfied.

Conditional Expression (A1): $0.7<t/T<1.0$

In a case where a surface of a body to be cleaned is cleaned by applying a cleaning body provided with a shaft and an elastic layer disposed by being spirally wound around an outer circumferential surface of the shaft from one end to the other end of the shaft and bringing the cleaning body into contact with the body to be cleaned, there has been room for further improving cleaning maintenance property for the body to be cleaned.

SUMMARY

Aspects of non-limiting embodiments of the present disclosure relate to a cleaning body having high cleaning maintenance property for the body to be cleaned as compared with a cleaning body provided with a shaft and an elastic layer disposed by being spirally wound around the outer circumferential surface of the shaft from one end to the other end of the shaft, in which a relationship (RaE/RaV) between line roughness of a protruding portion formed at an end portion of the elastic layer in a width direction (RaE) and line roughness of a center portion of the elastic layer in the width direction (RaV) is less than 5.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning body including:

a shaft; and an elastic layer disposed by being spirally wound around an outer circumferential surface of the shaft from one end to the other end of the shaft, wherein a relationship between line roughness of a protruding portion formed at an end portion of the elastic layer in a width direction (RaE) and line roughness of a center portion of the elastic layer in the width direction (RaV) satisfies $5 \leq RaE/RaV$.

BRIEF DESCRIPTION OF THE DRAWINGS

Exemplary embodiments of the present invention will be described in detail based on the following figures, wherein.

DETAILED DESCRIPTION

Figure 1:
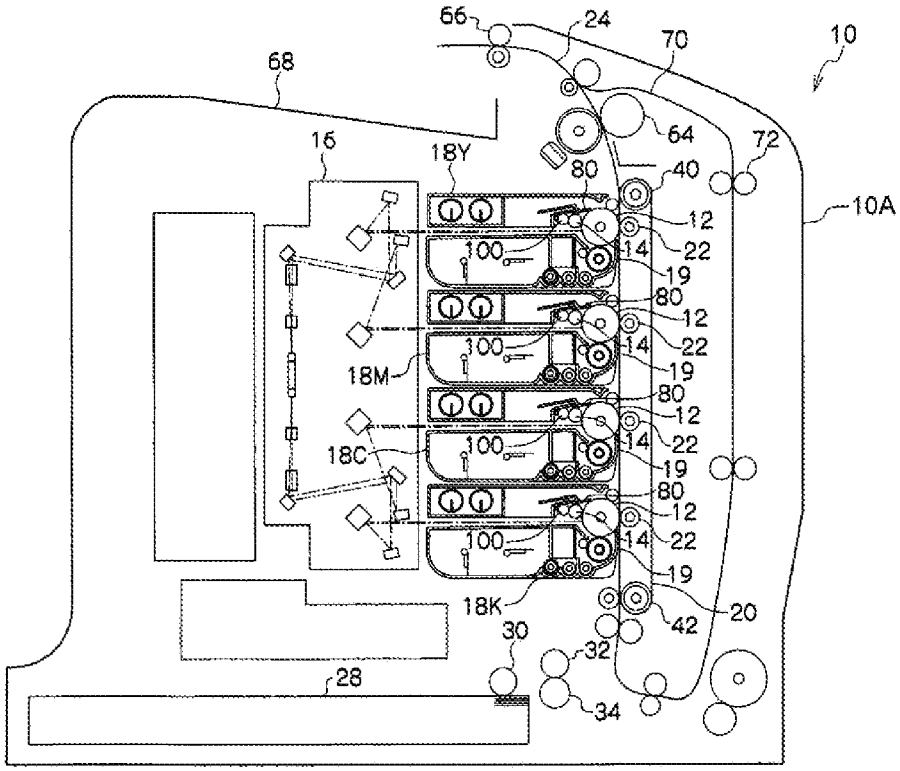
FIG. 1 is a schematic block diagram illustrating an example of an image forming apparatus according to an exemplary embodiment.

Hereinafter, an example of the exemplary embodiment according to the present invention is described with reference to drawings. Note that, components having the same function and the same action may be given the same reference numerals throughout the drawings, and the description thereof is not made in some cases.

A cleaning body according to this exemplary embodiment is provided with a shaft and an elastic layer disposed by being spirally wound around an outer circumferential surface of the shaft from one end to the other end of the shaft. In addition, a relationship between line roughness of a protruding portion formed at an end portion of the elastic layer in a width direction (RaE) and line roughness of a center portion of the elastic layer in the width direction (RaV) satisfies 5≤RaE/RaV.

Here, in the present specification, the "protruding portion" of the elastic layer is a portion formed at the end portion of the elastic layer in the width direction, and represents a part of a distance by 10% from one end side to the other end side of the shortest distance measured along the surface of the elastic layer from one end side to the other end side in the width direction of the elastic layer in a state where the elastic layer is disposed by being wound around the shaft. The "center portion" of the elastic layer represents a part excluding a protruding portion among the shortest distances measured along the surface of the elastic layer from one end side to the other end side of the elastic layer in the width direction of the elastic layer in a state where the elastic layer is disposed by being wound around the shaft.

According to the above-described configuration, the cleaning body according to the exemplary embodiment is a cleaning body having high cleaning performance for the body to be cleaned. The reason is inferred as follows.

When the elastic layer (for example, a strip-shaped elastic material) is spirally wound around the surface of the shaft from one end to the other end of the shaft, the elastic layer is provided in the state of being bent along a curved surface of the shaft on the shaft. At this time, the outermost circumferential surface of the elastic layer has a stress against bending which is most exerted, and thus is stretched outward of the cross section of the elastic layer in the circumferential direction. When this is viewed in a cross-sectional direction of the elastic layer, both end portions of the outermost circumferential surface of the elastic layer are pulled to the outermost side, and the maximum thickness is formed in a state where the end portions protrude. In the exemplary embodiment, a region corresponding to the above-described range and including a protruding portion on both ends is set as a protruding portion. On the other hand, the center portion of the outermost circumferential surface is pressed in the thickness direction, and when viewed from the cross-sectional direction of the elastic layer, it apparently forms a minimum thickness in a recess shape. In the exemplar) embodiment, the region forming the recess shape except for the protruding portions on both ends is set as a center portion.

In a case where the cleaning body is in contact with body to be cleaned and the surface of the body to be cleaned is cleaned, there existed room to further improve the cleaning maintenance property for the body to be cleaned. In particular, depending on the relationship between line roughness RaE of the protruding portion and line roughness RaV of the center portion when removing the contaminants attached to the gaps on a part where the surface roughness of the body to be cleaned is large, there is a tendency that the cleaning maintenance property for the body to be cleaned is deteriorated.

On the other hand, in the cleaning body according to the exemplary embodiment, in particular, when removing contaminants attached to the gaps on the part where the surface roughness of the body to be cleaned is large (a part where irregularities on the surface of the body to be cleaned are fine), the cleaning performance for the body to be cleaned is high. Since the line roughness RaE of the protruding portion is large, when the protruding portion of the elastic layer comes in contact with the surface of the body to be cleaned, the action of scraping out the contaminants attached to the body to be cleaned is excellent. That is, it is considered that the initial contact of the protruding portion allows the protruding portion to enter details of the surface of the body to be cleaned, thereby enabling efficient contact. In addition, if the line roughness RaV of the center portion is small, when the center portion of the elastic layer comes in contact with the surface of the body to be cleaned, the action of collecting the contaminants attached to the body to be cleaned is excellent. That is, it is considered that when the line roughness RaV of the recess is low, the more stable collection of the contaminants becomes possible at the time of the cleaning body contacting.

When the relationship between the line roughness RaE of the protruding portion and the line roughness RaV of the center portion satisfies RaE/RaV≥5, an action of scraping out the contaminants attached to the body to be cleaned and collecting them becomes excellent, and thus the cleaning body has high cleaning maintenance property for the body to be cleaned. Particularly, even on a part where the surface roughness of the body to be cleaned is large (that is, the part where irregularities on the surface of the body to be cleaned are fine), the contaminants may be effectively removed and the cleaning action works, in a state before deposition of the attached contaminants proceeds. Therefore, it is estimated that the cleaning body according to the exemplary embodiment is a cleaning body having a high cleaning performance for the body to be cleaned.

Hereinafter, details of the exemplary embodiment will be described with reference to the drawings.

(Image Forming Apparatus 10)

An image forming apparatus 10 according to the exemplary embodiment will be described. FIG. 1 is a schematic block diagram illustrating an image forming apparatus according to an exemplary embodiment.

The image forming apparatus 10 illustrated in FIG. 1 is an example of an image forming apparatus that forms an image. Specifically, the image forming apparatus 10 is an electrophotographic image forming apparatus that forms a toner image (an example of an image) on a recording medium 24. More specifically, as illustrated in FIG. 1, the image forming apparatus 10 is a tandem type image forming apparatus, and is configured as follows.

The image forming apparatus 10 includes a main body for an apparatus 10A. Process cartridges 18Y, 18M, 18C, and 18K (hereinafter, collectively referred to as 18) corresponding to yellow (Y), magenta (M), cyan (C), and black (K) are provided inside the main body for an apparatus 10A.

Figure 2:
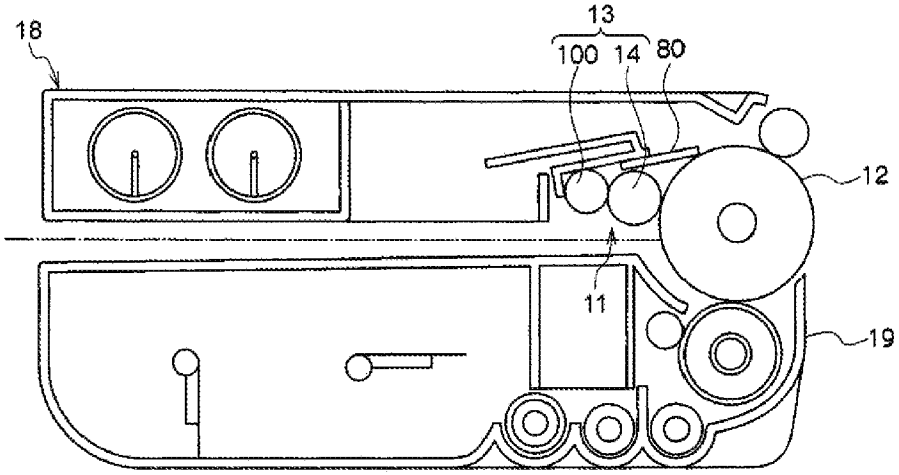
FIG. 2 is a schematic block diagram illustrating an example of a process cartridge according to the exemplary embodiment.

As illustrated in FIG. 2, each process cartridge 18 is provided with a photoreceptor 12 (an example of an image holding member, an example of a body to be charged) capable of holding an image, a charging device 11 having a charging member 14 (an example of a charging body), and a developing device 19. The process cartridge 18 is detachable from the main body for an apparatus 10A illustrated in FIG. 1, and functions as an example of an assembly which is detachably assembled to the main body for an apparatus 10A. Note that the assembly of the exemplary embodiment may be one provided with at least the photoreceptor 12 and the charging device 11. The specific configuration of the charging device 11 provided in the process cartridge 18 will be described later.

The surface of the photoreceptor 12 illustrated in FIG. 1 is charged by the charging member 14, and then subjected to image exposure by a laser beam emitted from the exposure device 16 to form an electrostatic latent image according to the image information. The electrostatic latent image formed on the photoreceptor 12 is developed by the developing device 19 to form a toner image.

For example, in a case of forming a color image, each process of charging, exposure, and development is performed, on the surface of the photoreceptor 12, corresponding to each color of yellow (Y), magenta (M), cyan (C), and black (K)m and a toner image corresponding to each color of yellow (Y), magenta (M), cyan (C), and black (K) is formed on the surface of the photoreceptor 12 of each color.

The toner image of teach color of yellow (Y), magenta (M), cyan (C) and black (K) sequentially formed on the photoreceptor 12 is transferred onto a recording medium 24 transported by the transport belt 20 through a transport belt 20 supported by support rolls 40 and 42, at a position where the photoreceptor 12 and a transfer device 22 face each other. Further, the recording medium 24 onto which the toner image is transferred from the photoreceptor 12 is transported to a fixing device 64, and is heated and pressed by the fixing device 64 to fix the toner image on the recording medium 24. Thereafter, in a case of single-sided printing, the recording medium 24 on which the toner image is fixed is discharged onto an output portion 68 provided on the upper portion of the image forming apparatus 10 by an output roll 66.

The recording medium 24 is taken out of a storage container 28 by a takeout roll 30 and transported to the transport belt 20 by transport rolls 32 and 34.

On the other hand, in a case of double-sided printing, the recording medium 24 with the toner image fixed on a first surface (front surface) by the fixing device 64 is not output onto the output portion 68 by the output roll 66, and the output roll 66 is reversely rotated in a state where a rear end portion of the recording medium 24 is nipped by the output roll 66. With this, the recording medium 24 is introduced into a transport path 70 for the double-sided printing, and is again transported, in a state where the front and back of the recording medium 24 are reversed, onto the transport belt 20 by the transport roll 72 disposed in the transport path 70 for the double-sided printing. Then, the toner image is transferred onto a second surface (back surface) of the recording medium 24 from the photoreceptor 12. Thereafter, the toner image on the second surface (back surface) of the recording medium 24 is fixed by the fixing device 64, and the recording medium 24 (transfer receiver) is output onto the output portion 68.

The surface of the photoreceptor 12 after a transfer process for the toner image is finished is the surface of the photoreceptor 12 every time the photoreceptor 12 makes one rotation, and a residual toner, paper dust, and the like are removed by a cleaning blade 80 which is disposed on the downstream side in a rotation direction of the photoreceptor 12 from a position where the transfer device 22 faces, thereby preparing for the next image forming process.

The image forming apparatus 10 according to the exemplary embodiment is not limited to the above-described configuration, and a known image forming apparatus such as an intermediate transfer type image forming apparatus may be employed.

(Charging Device 11)

Figure 3:
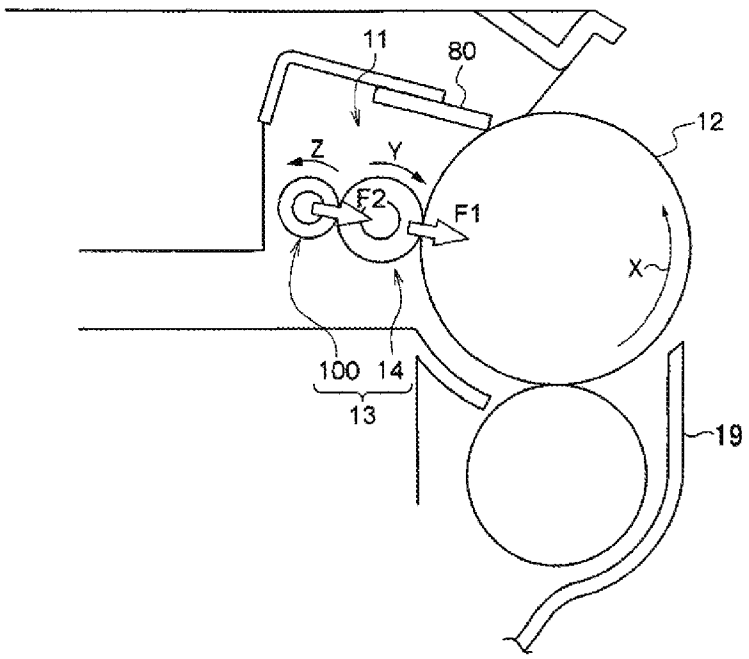
FIG. 3 is a schematic block diagram enlarging a peripheral part of a charging member (charging device) in FIGS. 1 and 2.

The charging device 11 (charging unit) is provided with a cleaning device 13 as illustrated in FIG. 3. The cleaning device 13 includes the above-described charging member 14 (an example of a charging body, an example of a body to be cleaned) for charging the photoreceptor 12 and a clean member 100 for cleaning the charging member 14. Hereinafter, specific configurations of the charging member 14 and the clean member 100 will be described.

(Charging Member 14)

Figure 4:
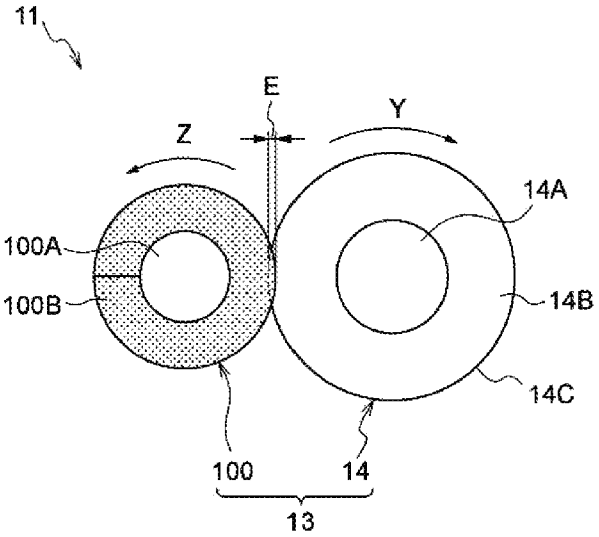
FIG. 4 is a schematic side view illustrating an example of a charging device according to the exemplary embodiment.

The charging member 14 illustrated in FIG. 3 is an example of the body to be cleaned having an irregular structure on the surface. The charging member 14 is also an example of a charging body that charges the body to be charged. Specifically, the charging member 14 is a charging roll that charges the photoreceptor 12. More specifically, as illustrated in FIG. 4, the charging member 14 includes a support 14A and a conductive elastic layer 14B.

(Support 14A)

Specifically, the support 14A is a shaft formed of a conductive cylindrical or cylindrical body. For example, free-cutting steel, stainless steel, or the like is used as the material of the support 14A, and a surface treatment method or the like is appropriately selected according to a necessary function such as slidability. In addition, in a case where a non-conductive material is used as a material of the support 14A, the conductivity may be imparted by a general conductive treatment such as a plating treatment.

(Conductive Elastic Layer 14B)

Specifically, the conductive elastic layer 14B is formed of a conductive foamed elastic layer. The conductive elastic layer 14B is laminated on the outer periphery of the support 14A, and is formed in a cylindrical shape.

As the materials for the conductive elastic layer 14B, for example, in addition to a conductive agent for the purpose of adjusting resistance, if necessary, materials that may be added to general rubbers, such as a softener, a plasticizer, a curing agent, a vulcanizing agent, a vulcanization accelerator, an anti-aging agent, and a filler such as silica or calcium carbonate may be added to an elastic material such as rubber having elasticity.

As the conductive agent for the purpose of adjusting the resistance value, a material, in which a material electrically conducting at least one of electrons and ions such as carbon black and an ion conductive agent mixed in a matrix material as a charge carrier is dispersed, is used.

The elastic material constituting the conductive elastic layer 14B is formed, for example, by dispersing the conductive agent in a rubber material. Examples of the rubber material include a silicone rubber, an ethylene propylene rubber, an epichlorohydrin-ethylene oxide copolymer rubber, an epichlorohydrin-ethylene oxide-allyl glycidyl ether copolymer rubber, an acrylonitrile-butadiene copolymer rubber, and a blended rubber thereof. These rubber materials may be foamed or non-foamed.

As the conductive agent, an electron conductive agent or an ion conductive agent is used. Examples of the electron conductive agent include fine powders such as carbon black such as ketjen black and acetylene black; pyrolytic carbon; graphite; various conductive metals or alloys such as aluminum, copper, nickel, and stainless steel; various conductive metal oxides such as tin oxide, indium oxide, titanium oxide, a tin oxide-antimony oxide solid solution, and a tin oxide-indium oxide solid solution; and a material obtained by performing a conductive treatment on a surface of an insulating material.

In addition, examples of the ion conductive agent include perchlorates and chlorates of oniums such as tetraethyl ammonium and lauryl trimethyl ammonium; alkaline metals such as lithium and magnesium; and perchlorate and chlorate such as alkaline earth metal. Note that, these conductive agents may be used alone or in combination of two or more kinds thereof.

Further, the addition amount thereof is not particularly limited, but in the case of the electronic conductive agent, it is preferably in the range of 1 part by weight to 60 parts by weight with respect to 100 parts by weight of the rubber material, and in a case of the ion conductive agent, it is preferably in the range of 0.1 part by weight to 5.0 parts by weight with respect to 100 parts by weight of the rubber material. By controlling the resistance value with such a conductive agent, the conductive elastic layer 14B may obtain stable characteristics without changing the resistance depending on the environmental conditions.

The surface of the charging member 14 may form a surface layer 14C. A material of the surface layer 14C is not particularly limited, and any of polymer materials such as a resin (a polymer material) and a rubber may be used.

Examples of the polymer material contained in the surface layer 14C include polyvinylidene fluoride, a tetrafluoroethylene copolymer, polyester, polyimide, and copolymer nylon. The polymer material contained in the surface layer 14C may be a fluorine-based or silicone-based resin or the like. The polymer materials may be used alone or in combination of two or more kinds thereof.

The surface layer 14C may contain a conductive material to adjust the resistance value. Examples of the conductive material for the purpose of adjusting the resistance value include carbon black, a conductive metal oxide particle, and an ion conductive agent.

The conductive materials may be used alone or in combination of two or more kinds thereof.

The surface layer 14C may contain an insulating particle such as alumina and silica.

(Supporting Structure of Charging Member 14)

In the charging member 14 illustrated in FIG. 3, both axial ends of the support 14A are rotatably supported by a support (not shown) such as a bearing. The charging member 14 is pressed against the photoreceptor 12 by applying a load F1 to both of the axial ends of the support 14A via the support. With this, the conductive elastic layer 14B elastically deforms along the surface (outer circumferential surface) of the photoreceptor 12 to form a contact range having a specific width between the charging member 14 and the photoreceptor 12.

Further, when the photoreceptor 12 is rotationally driven in an arrow X direction by a motor (not shown), the charging member 14 is driven to rotate in an arrow Y direction following the rotation of the photoreceptor 12. That is, the charging member 14 is driven to rotate with the axial direction of the support 14A as the rotational axis direction. Therefore, the axial direction of the charging member 14 and the axial direction of the support 14A correspond to the rotational axial direction of the charging member 14. The clean member 100 is driven to rotate in an arrow Z direction by the rotation of the charging member 14.

(Clean Member 100)

Figure 5:
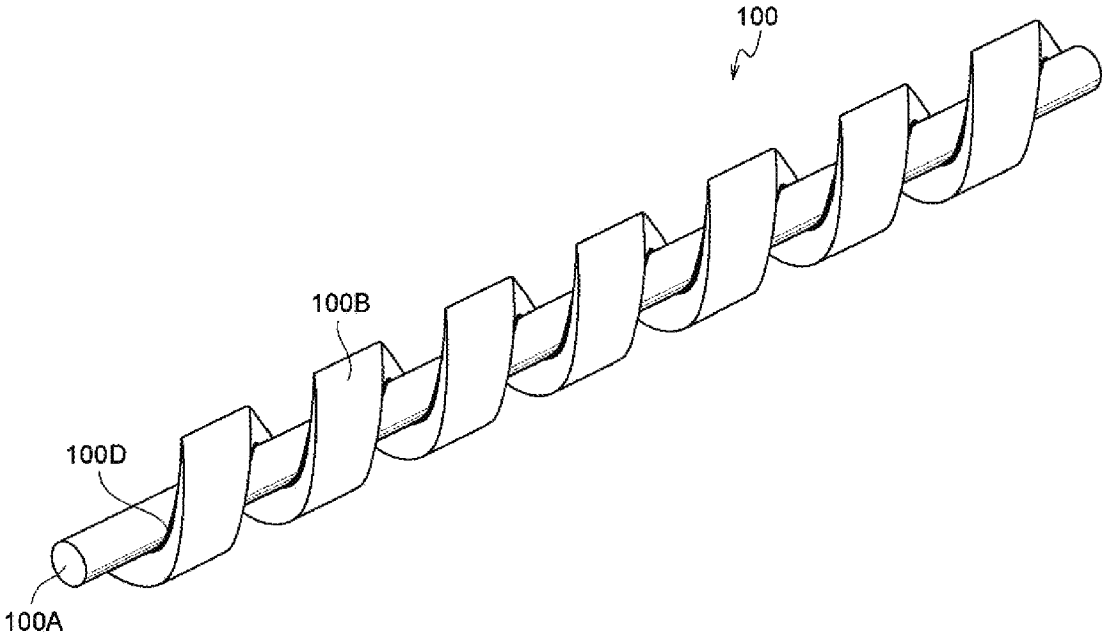
FIG. 5 is a schematic perspective view illustrating an example of a cleaning body according to the exemplary embodiment.
Figure 6:
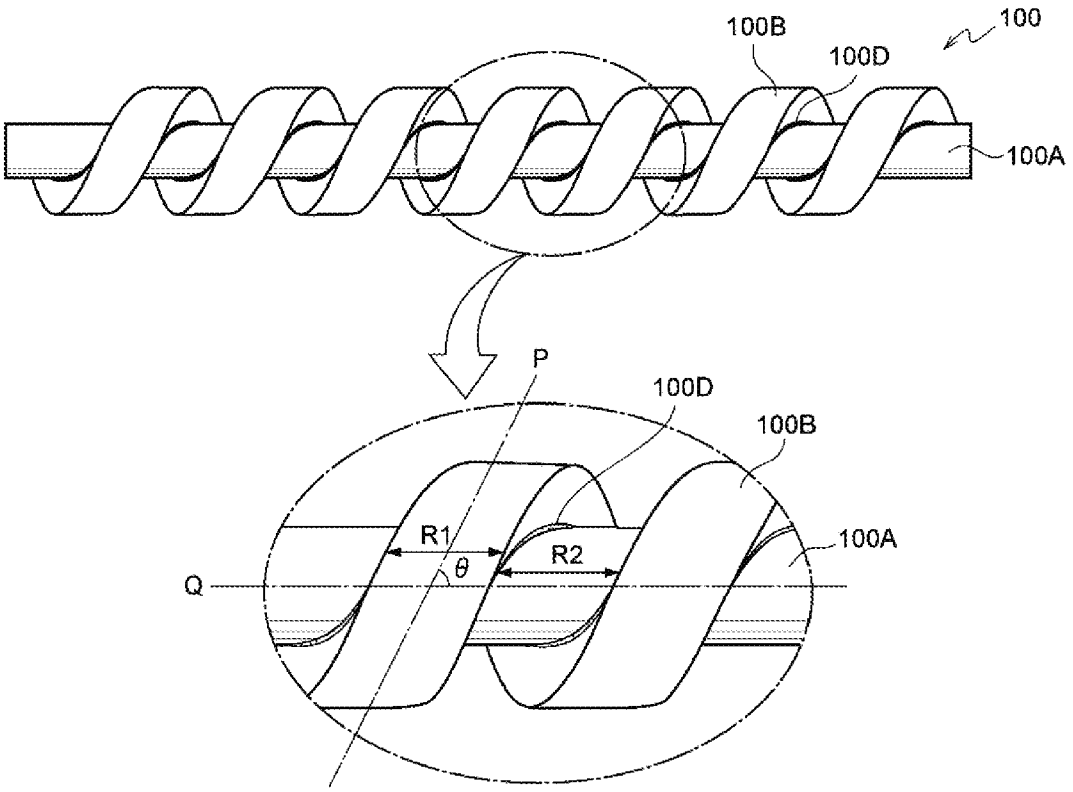
FIG. 6 is a schematic plan view illustrating an example of a cleaning body according to the exemplary embodiment.

FIG. 5 is a schematic perspective view illustrating a clean member (an example of a cleaning body) according to the exemplary embodiment. FIG. 6 is a schematic plan view illustrating a clean member (an example of a cleaning body) according to the exemplary embodiment.

The clean member 100 (an example of the cleaning body) illustrated in FIGS. 5 and 6 is provided with a core 100A (an example of a shaft) and a foamed elastic layer 100B (an example of an elastic layer) which is provided on the outer circumferential surface of the core 100A and is in contact with the charging member 14. In addition to the core 100A and the foamed elastic layer 100B, the clean member 100 includes an adhesive layer 100D which bonds the core 100A and the foamed elastic layer 100B, and is set as a roll-shaped member.

(Core 100A)

As a material used for the core 100A, metal (for example, free-cutting steel, stainless steel, or the like) or a resin (for example, a polyacetal resin (POM)) may be exemplified. Note that, it is desirable to select a material and a surface treatment method as needed.

In particular, in a case where the core 100A is made of metal, it is desirable to perform a plating treatment. In addition, in a case where a resin or the like does not have conductivity, it may be processed by a general treatment such as the plating treatment so as to conduct a conductivity treatment, or may be used as it is.

(Adhesive Layer 100D)

The adhesive layer 100D is not particularly limited as long as it may bond the core 100A and the foamed elastic layer 100B, and is made of, for example, a double-sided tape or another adhesive.

(Foamed Elastic Layer 100B)

The foamed elastic layer 100B is made of a material (so-called foamed body) with air bubbles. The specific material of the foamed elastic layer 100B will be described later.

Figure 8:
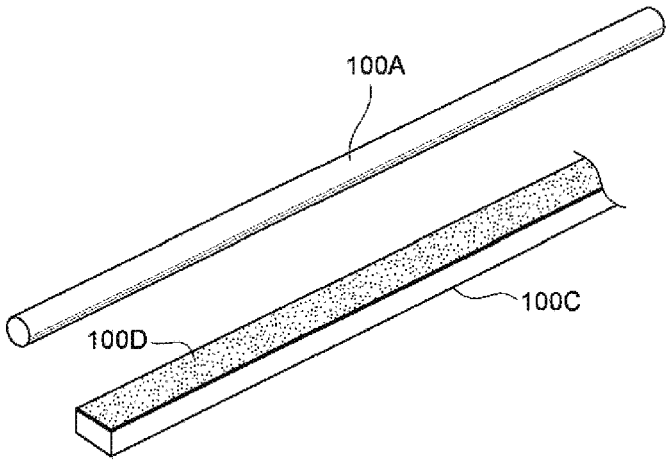
FIG. 8 is a process drawing illustrating a process in an example of a method of manufacturing a cleaning body according to the exemplary embodiment.
Figure 9:
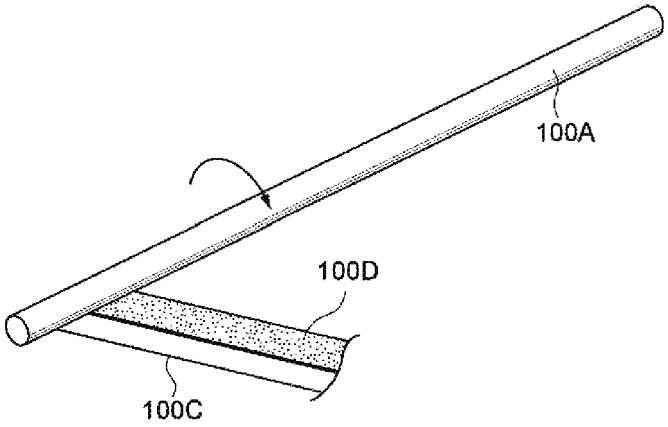
FIG. 9 is a process drawing illustrating a process in an example of a method of manufacturing a cleaning body according to the exemplary embodiment.
Figure 10:
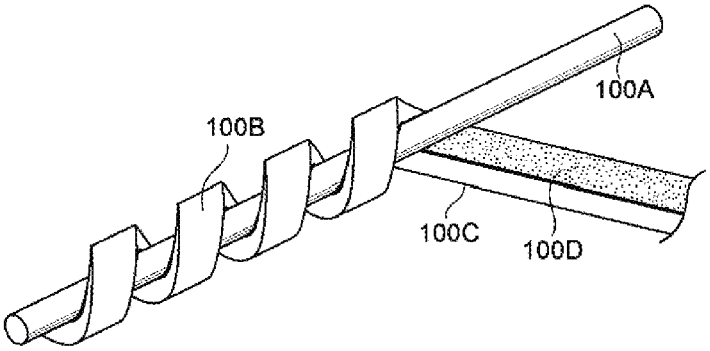
FIG. 10 is a process drawing illustrating a process in an example of a method of manufacturing a cleaning body according to the exemplary embodiment.

As illustrated in FIGS. 5 and 6, the foamed elastic layer 100B is disposed by being spirally wound around the outer circumferential surface of the core 100A from one axial end to the other axial end of the core 100A. Specifically, as illustrated in FIGS. 8 to 10, the foamed elastic layer 100B is formed such that the core 100A is set as a spiral shaft from one axial end to the other axial end of the core 100A, and a strip-shaped foamed elastic member 100C (hereinafter, may be referred to as a strip 100C) is formed to be spirally wound around the core 100A with intervals.

Figure 7:
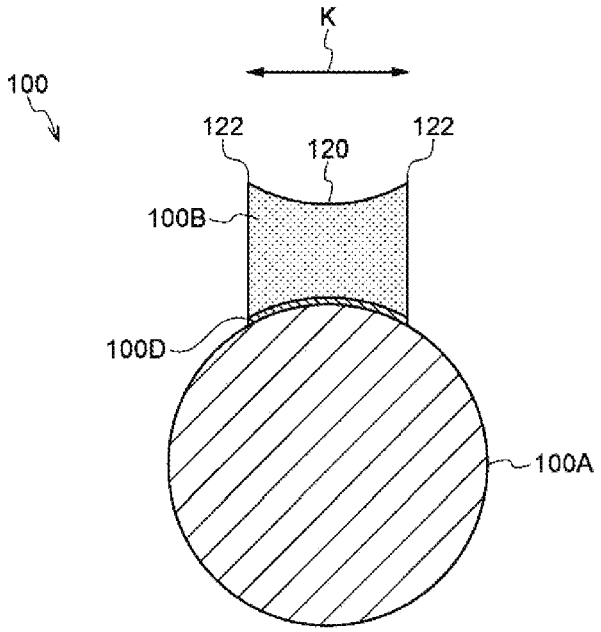
FIG. 7 is a schematic sectional view illustrating an example of the cleaning body in an axial direction according to the exemplary embodiment.

FIG. 7 is a schematic sectional view illustrating the clean member (an example of the cleaning body) in an axial direction according to the exemplary embodiment. As illustrated in FIG. 7, the foamed elastic layer 100B has a quadrilateral shape surrounded by four sides (including a curve) on a cross section of the core 100A in the axial direction, and includes a protruding portion 122 which is provided at both end portions of the foamed elastic layer 100B in the axial direction (K direction), and protrudes radially outward of the core 100A from the center portion 120. The protruding portion 122 is formed along the longitudinal direction of the foamed elastic layer 100B.

Then, when the protruding portion 122 applies, for example, tension to the foamed elastic layer 100B in the longitudinal direction, an outer diameter difference is generated and formed in the center portion 120 of the outer circumferential surface of the foamed elastic layer 100B in the width direction and the both end portions in the width direction. Here, in the exemplary embodiment, the range of the protruding portion 122 refers to a range of up to 10% from one end side to the other end side of the distance in the K direction measured along the surface of the elastic layer curved in a recess. Moreover, the range of the center portion 120 refers to a part except the range of the protruding portion 122 at both ends in the K direction.

The thickness (thickness at the center portion in the width direction) of the foamed elastic layer 100B may, for example, 1.0 mm to 3.0 mm, is preferably 1.4 mm to 2.6 mm, and is more preferably 1.6 mm to 2.4 mm.

The thickness of the foamed elastic layer 100B is measured, for example, as follows.

Using a laser measuring machine (laser scanning micrometer, manufactured by Mitutoyo Corporation), a profile of the thickness of the foamed elastic layer (foamed elastic layer thickness) is measured by scanning the foamed elastic layer in the longitudinal direction (axial direction) of the clean member at a traverse speed of 1 mm/s in a state where the circumferential direction of the clean member is fixed. After that, the same measurement is performed by shifting the position in the circumferential direction (the position in the circumferential direction is located at three points at 120° intervals). The thickness of the foamed elastic layer 100B is calculated based on this profile.

The foamed elastic layer 100B is disposed in a spiral shape. Specifically, the foamed elastic layer 100B may have, for example, a spiral angle θ of 15° to 65° (preferably 25° to 45°) and a spiral width R1 of 3 mm to 25 mm (preferably 3 mm to 10 mm). A spiral pitch R2 may be, for example, 3 mm to 25 mm (preferably 15 mm to 22 mm) (refer to FIG. 6).

The foamed elastic layer 100B may have a coverage ratio (spiral width R1 of foamed elastic layer 100B/[spiral width R1 of foamed elastic layer 100B+spiral pitch R2 of foamed elastic layer 100B: (R1+R2)]) which is 20% to 70%, and is preferably 25%/0 to 55%.

When the coverage ratio is larger than the above range, the time during which the foamed elastic layer 100B is in contact with the body to be cleaned becomes longer, and thus the deposits attached to the surface of the clean member are more likely to re-contaminate the body to be cleaned; however, when the coverage ratio is smaller than the above range, the thickness of the foamed elastic layer 100B becomes difficult to stabilize, and the cleaning ability tends to be deteriorated.

The spiral angle θ means an angle (acute angle) at which a longitudinal direction P (a spiral direction) of the foamed elastic layer 100B intersects with an axial direction Q (a core axial direction) of the core 100A (refer to FIG. 6).

The spiral width R1 means the length of the foamed elastic layer 100B along the axial direction Q (the core axial direction) of the clean member 100.

The spiral pitch R2 means the length between adjacent foamed elastic layers 100B along the axial direction Q (the core axis direction) of the clean member 100 of the foamed elastic layer 100B.

In addition, the foamed elastic layer 100B refers to a layer made of a material that restores its original shape even when deformed by the application of an external force of 100 Pa.

(Material of Foamed Elastic Layer 100B)

Examples of the material of the foamed elastic layer 100B include one selected from foamed resins (polyurethane, polyethylene, polyamide, and polypropylene), and rubber materials (a silicone rubber, a fluorine rubber, and a urethane rubber, EPDM (an ethylene.propylene.diene rubber), NBR (an acrylonitrile-butadiene copolymer rubber), CR (a chloroprene rubber), a chlorinated polyisoprene rubber, an isoprene rubber, an acrylonitrile-butadiene rubber, a styrene-butadiene rubber, a hydrogenated polybutadiene rubber, and a butyl rubber), and materials obtained by blending two or more thereof.

In addition, an auxiliary agent such as a foaming auxiliary agent, a foam regulating agent, a catalyst, a hardening agent, a plasticizer, or a vulcanization accelerator may be added as needed.

Particularly, the foamed elastic layer 100B is preferably a polyurethane foam that is resistant to tension, from the viewpoint of preventing scratches to the surface of the body to be cleaned (charging member 14) due to rubbing, and preventing breakage or damage for a long time of period.

As polyurethane, for example, a reactant of polyol (for example, polyester polyol, polyether polyol, polyester, and acrylic polyol) with isocyanate (for example, 2,4-tolylene diisocyanate, 2,6-tolylene diisocyanate, 4,4-diphenylmethane diisocyanate, tolylene diisocyanate, and 1,6-hexamethylene diisocyanate), is exemplified and a material containing a chain extender (1.4-butanediol or trimethylolpropane) may be exemplified.

Foaming of polyurethane is generally performed using a foaming agent such as water or an azo compound (for example, azodicarbonamide and azobisisobutyronitrile).

The foamed polyurethane may be added with an auxiliary agent such as a foaming auxiliary agent, a foam control agent, and a catalyst, as needed.

The number of cells of the foamed elastic layer 100B is preferably 80 cells/25 mm to 105 cells/25 mm, and is more preferably 85 cells/25 mm to 100 cells/25 mm, from the viewpoint of obtaining a cleaning body having high cleaning performance for the body to be cleaned. The number of cells of the foamed elastic layer 100B is calculated based on JIS K 6400-1: 2004 (Appendix 1).

(Configuration of Foamed Elastic Layer 100B)

In the foamed elastic layer 100B, the relationship between the line roughness RaE of the protruding portion and the line roughness RaV of the center portion satisfies RaE/RaV≥5. From the viewpoint of obtaining the cleaning body having high cleaning performance for the body to be cleaned (particularly, from the viewpoint of enhancing the cleaning performance for the body to be cleaned having details having a large surface irregularities), RaE/RaV≥6 is preferable and RaE/RaV≥7 is more preferable. Further, the upper limit of RaE/RaV is not particularly limited, and may be, for example, 15 or less.

From the viewpoint of obtaining the cleaning body having high cleaning performance for the body to be cleaned, the line roughness RaE of the protruding portion is preferably 20 or more, and is more preferably 50 or more. Further, the upper limit of RaE is not particularly limited, and may be, for example, 100 or less.

From the viewpoint of obtaining the cleaning body having high cleaning performance for the body to be cleaned, the line roughness RaV of the center portion is preferably 5 or more, and is more preferably 7 or more. Further, the upper limit of RaV is not particularly limited, and may be, for example, 20 or less.

The line roughness RaE of the protruding portion and the line roughness RaV of the center portion may be controlled by a material type of the elastic layer, a foaming density and structure, and a width (spiral width) when the elastic layer is wound around a core (an example of a shaft) and a winding angle (spiral angle).

Here, the line roughness RaE of the protruding portion and the line roughness RaV of the center portion are measured as follows. First, both ends of the shaft of the cleaning body to be measured are mounted and fixed on a V-shaped block on a measurement table of a laser microscope (VK; manufactured by Keyence Corporation). Next, the surface of the elastic layer is directly observed to obtain an analysis image. Then, the line roughness of the protruding portion calculated from the image analysis by this measurement is taken as an index of RaE, and the line roughness of the center portion is taken as an index of RaV. Specifically, it is performed as follows. The surface (measurement area (100 μm×100 μm)) of the elastic layer to be measured is scanned at a pitch of 0.01 μm in the depth direction with a 100-fold objective lens, and from the obtained image data, measurement is made at six locations each having a 10 μm square area, and the average value of the measured six locations is calculated. The observation of the protruding portion is performed by observing the peripheral portion of the end side to measure RaE. The line roughness RaV of the center portion is measured by observing the peripheral part which is the most recessed area.

In the cleaning body according to the exemplary embodiment, the number of cells of the elastic layer is 80 cells/25 mm to 105 cells/25 mm, and the spiral angle of the elastic layer is preferably 15° to 65° from the viewpoint of obtaining the cleaning body having high cleaning performance for the body to be cleaned. From the same point of view, it is more preferable that the number of cells of the elastic layer is 85 cells/25 mm to 100/25 mm, and the spiral angle of the elastic layer is 25° to 45°.

In the cleaning body according to the exemplary embodiment, when W is set as a width of a nodal section of a foam cell wall surface of the elastic layer, the width W of the nodal section of the foam cell wall surface, is preferably 30 μm to 90 μm, and is more preferably 35 μm to 45 μm, from the viewpoint of obtaining the cleaning body having high cleaning performance for the body to be cleaned.

Figure 13:
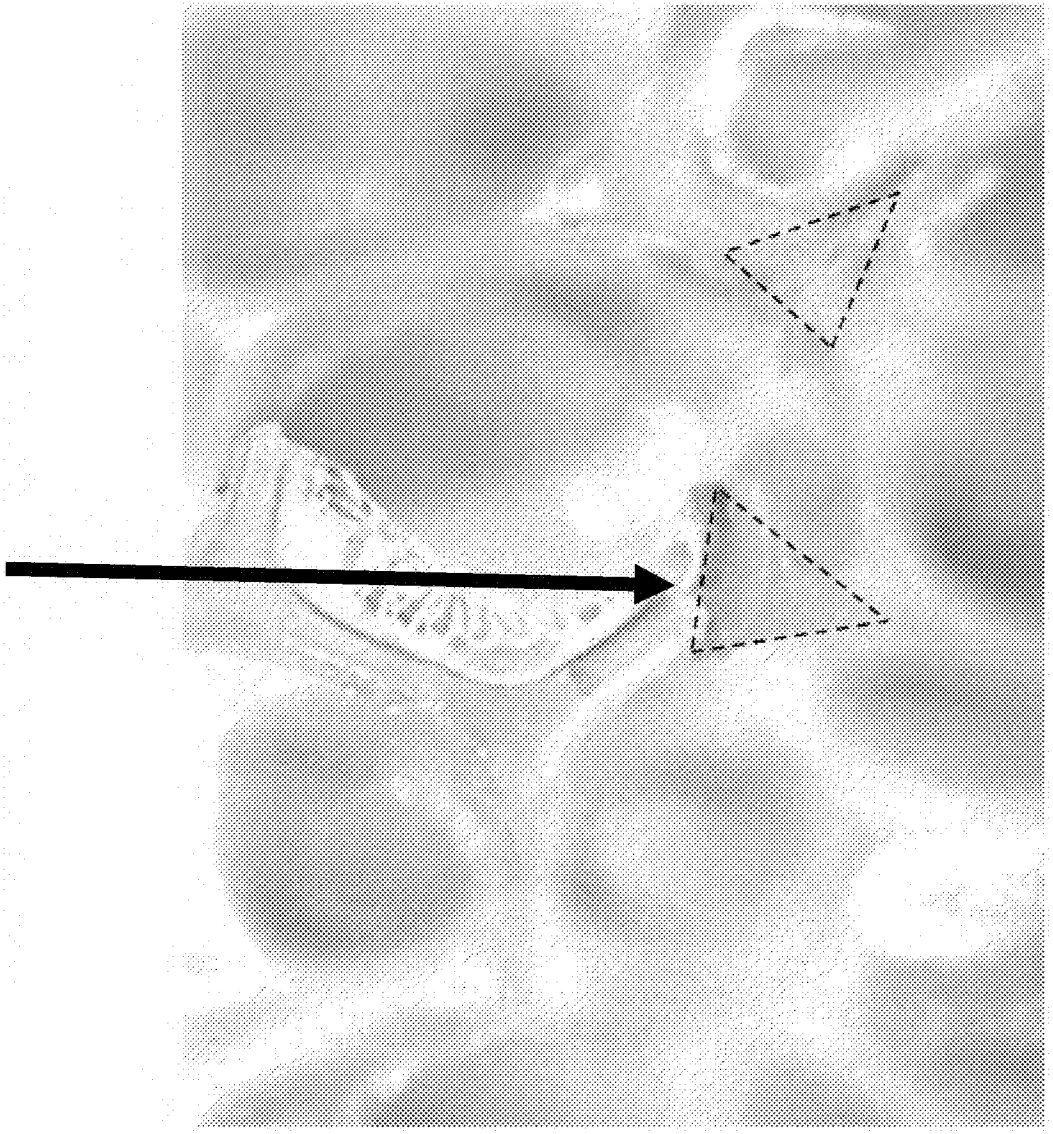
FIG. 13 is a view showing the width W of the nodal section of the foam cell wall surface of the elastic layer according to another exemplary embodiment.

In the present specification, "the width of the nodal section of the foam cell wall surface of the elastic layer" is defined as follows. As shown according to a non-limiting embodiment in FIG. 13, when the foamed elastic layer of the clean member is observed by a method of measuring the width W of the nodal section of the foam cell wall surface shown below, a length of each side of the protruding triangular area formed by the foam cell wall surface of the foamed elastic layer (that is, the portion to be the skeleton forming the foam cell of the foamed elastic layer) is measured, and the resultant obtained by calculating the average of the length of each side of the measured triangular area is set as "the width of the nodal section of the foam cell wall surface of an elastic layer".

The width W of the nodal section of the foam cell wall surface is measured using a confocal microscope (OPTELICS HYBRID, manufactured by Lasertec Corporation) to measure the width of the nodal section of the foam cell wall surface. An observation image of 1386 μm×1038 μm square is captured at three locations, and the average value obtained by measuring all widths of nodal sections in the observation image is used.

(Supporting Structure of Clean Member 100)

In the clean member 100, as illustrated in FIG. 3, the foamed elastic layer 100B is in contact with the charging member 14 on the side opposite to the photoreceptor 12 for the charging member 14. Specifically, in the clean member 100, when both axial end portions of the core 100A are pushed toward the charging member 14 by a load F2, the foamed elastic layer 100B is pressed to the charging member 14, and the foamed elastic layer 100B elastically deforms along the circumferential surface of the charging member 14 to form a contact area.

The foamed elastic layer 100B has a compression ratio calculated by [(thickness of original foamed elastic layer 100B−thickness of foamed elastic layer 100B in contact area of charging member 14 (that is, body to be cleaned))/thickness of original foamed elastic layer 100B]×100.

Here, the thickness of the foamed elastic layer 100B refers to the thickness of the center portion in the width direction in a state where the foamed elastic layer 100B is disposed on the core 100A.

A biting amount E (refer to FIG. 4) of the clean member 100 with respect to the charging member 14 is obtained by a difference between an axial distance between the charging member 14 and the clean member 100 and a value obtained by adding an unloaded radius of the clean member 100 to an unloaded radius of the charging member 14. In a case where the biting amount is different in the axial direction of the clean member 100, the biting amount here means the minimum value.

The clean member 100 is driven to rotate in an arrow Z direction by the rotation of the charging member 14. The present invention is not limited to the case where the clean member 100 is always in contact with the charging member 14, and a configuration in which the clean member 100 is in contact with the charging member 14 and is driven to rotate only when the charging member 14 is cleaned. In addition, the clean member 100 may be brought into contact the charging member 14 only when the charging member 14 is cleaned, and may be separately driven to rotate around the charging member 14 with a peripheral speed difference.

(Method of Manufacturing Clean Member 100)

Next, a method of manufacturing the clean member 100 according to the exemplary embodiment will be described. FIGS. 8 to 10 are process drawings illustrating a process in an example of a method of manufacturing the clean member 100 (an example of the cleaning body) according to the exemplary embodiment.

First, as illustrated in FIG. 8, a sheet-like foamed elastic member (foamed polyurethane sheet or the like) sliced to a target thickness is prepared, and the member is punched out by a punching die to obtain a sheet having a target width and length.

A double-sided tape 100D is attached to one side of this sheet-like foamed elastic member to obtain a strip 100C (a strip-shaped foamed elastic member with the double-sided tape 100D) having a target width and length.

Next, as illustrated in FIG. 9, the strip 100C is disposed with the surface with the double-sided tape 100D facing upward, in this state, one end of release paper of the double-sided tape 100D is peeled off, and one end portion of the core 100A is placed on the double-sided tape with the release paper peeled off.

Next, as illustrated in FIG. 10, while peeling off the release paper of the double-sided tape, the core 100A is rotated at a target speed to spirally wind the strip 100C around the outer circumferential surface of the core 100A so as to obtain the clean member 100 including the foamed elastic layer 100B spirally disposed on the outer circumferential surface of the core 100A.

Here, when the strip 100C to be the foamed elastic layer 100B is wound around the core 100A, the strip 100C may be positioned such that the longitudinal direction of the strip 100C is a target angle (a spiral angle) with respect to the axial direction of the core 100A. The outer diameter of the core 100A may be 43 mm to 46 mm, for example.

The tension applied when winding the strip 100C around the core 100A is preferably such that no gap is generated between the core 100A and the double-sided tape 100D of the strip 100C, and it is preferable not to apply an excessive tension. When the tension is excessively applied, tensile permanent elongation tends to be increased and the elastic force of the foamed elastic layer 100B necessary for cleaning tends to be deteriorated. Specifically, for example, the tension may be set to the elongation falling within the range of more than 0% and 5% or less with respect to the length of the original strip 100C.

On the other hand, when the strip 100C is wound around the core 100A, the strip 100C tends to be elongated. This elongation differs in the thickness direction of the strip 100C, and the outermost portion tends to be most elongated, and the elastic force may be deteriorated. Therefore, it is preferable that the elongation of the outermost portion after winding the strip 100C around the core 100A is about 5% with respect to the outermost portion of the original strip 100C.

The elongation is controlled by the radius of curvature at which the strip 1000 is wound around the core 100A and the thickness of the strip 100C, and the radius of curvature at which the strip 100C is wound around the core 100A is controlled by the outer diameter of the core 100A and the winding angle (spiral angle θ) of the strip 100C.

The radius of curvature at which the strip 100C is wound around the core 100A may be, for example, ((core outer diameter/2)+0.2 mm) to ((core outer diameter/2)+8.5 mm), and is preferably ((core outer diameter/2)+0.5 mm) to ((core outer diameter/2)+7.0 mm).

The thickness of the strip 100C may be, for example, 1.5 mm to 4 mm, and is preferably 1.5 mm to 3.0 mm. In addition, the width of the strip 100C may be adjusted such that the coverage ratio of the foamed elastic layer 100B is in the above range. Further, the length of the strip 100C is determined by, for example, the axial length of the area to be wound around the core 100A, the winding angle (the spiral angle θ), and the tension at the time of winding.

(Action of the Exemplary Embodiment)

Next, the action of the exemplary embodiment will be described.

In the exemplary embodiment, a foreign matter such as a developer remaining on the photoreceptor 12 without being transferred to the recording medium 24 is removed from the photoreceptor 12 by a cleaning blade 80. Some foreign matters such as a developer that has slipped through the cleaning blade 80 without being removed by the cleaning blade 80 are attached to the surface of the charging member 14 (refer to FIG. 1).

The foreign matters attached to the surface of the charging member 14 is removed by wiping the outer circumferential surface of the charging member 14 with the protruding portion 122 and the outer circumferential surface (an upper surface in FIG. 7) in contact with the charging member 14. Further, in the exemplary embodiment, since the relationship between the line roughness RaE of the protruding portion 122 and the line roughness RaV of the center portion 120 satisfies 5≤RaE/RaV, the cleaning performance is high (that is, the cleaning maintenance property is high).

Modification Example

Figure 11:
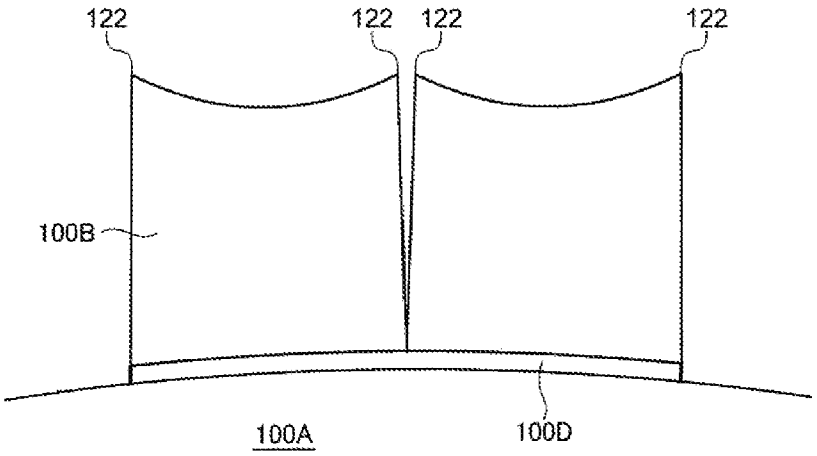
FIG. 11 is an enlarged sectional view illustrating a foamed elastic layer in a cleaning body according to another exemplary embodiment.

The foamed elastic layer 100B is not limited to the configuration of one strip 100C. For example, as illustrated in FIGS. 11 and 12, the foamed elastic layer 100B may be configured to include at least two or more strips 100C (strip-shaped foamed elastic members), in which the two or more strips 100C are spirally disposed on the core 100A.

Figure 12:
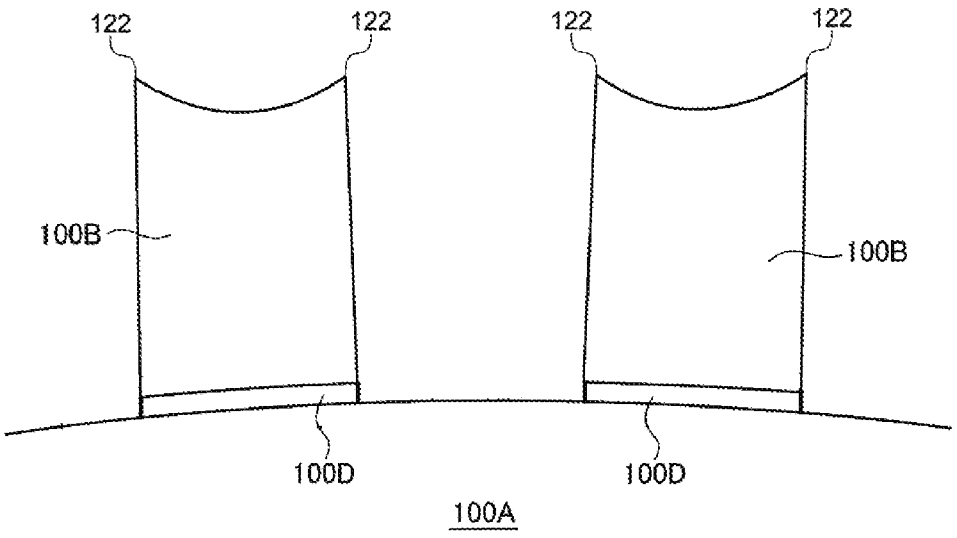
FIG. 12 is an enlarged sectional view illustrating a foamed elastic layer in the cleaning body according to another exemplary embodiment.

Further, the foamed elastic layer 100B configured by spirally winding two or more strips 100C (strip-shaped foamed elastic members) around the core 100A may have a configuration in which the strips are disposed by being spirally wound around the core in a state where the sides in the longitudinal direction of the adhesive surface of the strip 100C (the surface on the side opposite to the outer circumferential surface of the core 100A in the strip 100C) are in contact with each other (refer to FIG. 11) or a configuration in which the strips are disposed by being spirally wound around the core in a state where the sides are not in contact with each other (refer to FIG. 12).

Other Modification Examples

Further, in the image forming apparatus 10 according to the exemplary embodiment, the configuration in which the charging device 11 is formed of a unit of the charging member 14 and the clean member 100 is described, that is, the configuration in which the charging member 14 is employed as a body to be cleaned is described; however, the configuration is not limited thereto. For example, as the body to be cleaned, a photoreceptor (an image holding member), a transfer device (a transfer member; a transfer roll), and an intermediate transfer body (an intermediate transfer belt) are exemplified. Then, the unit of the body to be cleaned and the clean member disposed being in contact with the body to be cleaned may be directly disposed in the image forming apparatus, or may be formed into a cartridge like a process cartridge to be disposed in the image forming apparatus as described above.

The present invention is not limited to the above exemplary embodiments, and various modification examples, alterations, and improvements may be made without departing from the subject matter of the present invention. For example, the modification examples described above may be combined with each other as appropriate.

EXAMPLES

Hereinafter, the present invention will be more specifically described by way of examples. However, these examples do not limit the present invention.

[Charging Roll]

(Formation of Elastic Layer)

The following mixture is kneaded with an open roll, an outer circumferential surface of a conductive support made of SUS416 which has a diameter of 9 mm and a length of 370 mm is cylindrically coated with the kneaded mixture such that the thickness of the outer circumferential surface is 1.5 mm, and then the resultant is put into a cylindrical mold having an inner diameter of 12.0 mm, vulcanized at 170° C. for 30 minutes, taken out from the mold, and then polished. Thus, a cylindrical conductive elastic layer is obtained.

- Rubber material (epichlorohydrin-ethylene oxide-allyl glycidyl ether copolymer rubber, GECHRON 3106 produced by ZEON CORPORATION) 100 parts by weight
- Conductive agent (Carbon black Asahi Thermal produced by Asahi Carbon Co., Ltd.) 25 parts by weight
- Conductive agent (Ketjen black EC produced by Lion Corporation) 8 parts by weight
- Ion conductive agent (lithium perchlorate) 1 part by weight
- Vulcanization agent (sulfur, 200 mesh produced by Tsurumi Chemical Industry Co., Ltd.) 1 part by weight
- Vulcanization accelerator (NOCCELER DM produced by Ouchi Shinko Chemical Industrial Co., Ltd.) 2.0 parts by weight
- Vulcanization accelerator (NOCCELER TT produced by Ouchi Shinko Chemical Industrial Co., Ltd.) 0.5 parts by weight (Formation of Surface Layer)

The following mixture is dispersed by a bead mill, the obtained dispersion is diluted with methanol, the surface (outer circumferential surface) of the conductive elastic layer is dip coated with the obtained dispersion, and then the surface is dried by heating at 140° C. for 15 minutes. Thus, a charging roll 1 including a surface layer having a thickness of 4 μm is obtained.

Polymer material (Copolymerized nylon, AMILAN CM 8000, produced by Toray Industries, Inc.) 20 parts by weight Conductive agent (antimony-doped tin oxide, SN-100P produced by ISHIHARA SANGYO KAISHA, Ltd.) 30 parts by weight Solvent (methanol) 500 parts by weight Solvent (butanol) 240 parts by weight Example 1

[Cleaning Roll 1]

A foamed urethane sheet having a thickness of 2.4 mm (FHS produced by INOAC CORPORATION) is cut into a strip having a wide of 5 mm and a length of 360 mm. A double-sided tape (No. 5605 produced by NITTO DENKO CORPORATION) having a thickness of 0.05 mm is attached to the entire surface of the strip to obtain a strip with a double-sided tape.

The obtained strip with the double-sided tape is placed on a horizontal table with the release paper attached to the double-sided tape facing downward, and a longitudinal tip is compressed from a top with heated stainless steel such that a thickness in a range of 1 mm in the longitudinal direction from the longitudinal tip of the strip is 15% of a thickness of the other portion.

The obtained strip with the double-sided tape is placed on the horizontal table with the release paper attached to the double-sided tape facing upward, and is wound around a metal core (material=SUM24EZ, outer diameter=5.0 mm, entire length=360 mm) while applying a tension to the metal core such that a spiral angle θ is 15° and the entire length of the strip is elongated in a range of 0% to 5%, thereby obtaining a cleaning roll 1.

Example 2

[Cleaning Roll 2]

A cleaning roll 2 is obtained in the same manner as in the preparation of the cleaning roll 1 except that the spiral angle θ for winding the strip with the double-sided tape around the core is set to be 30°.

Example 3

[Cleaning Roll 3]

A cleaning roll 3 is obtained in the same manner as in the preparation of the cleaning roll 1 except that the spiral angle θ for winding the strip with the double-sided tape around the core is set to be 45°.

Example 4

[Cleaning Roll 4]

A cleaning roll 4 is obtained in the same manner as in the preparation of the cleaning roll 3 except that a foamed urethane sheet having a thickness of 3.0 mm and a width of 10 mm is used.

Example 5

[Cleaning Roll 5]

A cleaning roll 5 is obtained in the same manner as in the preparation of the cleaning roll 3 except that a foamed urethane sheet (EP70S produced by INOAC CORPORATION) is used.

Comparative Example 1

[Cleaning Roll 6]

A cleaning roll 6 is obtained in the same manner as in the preparation of the cleaning roll 5 except that the spiral angle θ for winding the strip with the double-sided tape around the core is set to be 30°.

Comparative Example 2

[Cleaning Roll 7]

A cleaning roll 7 is obtained in the same manner as in the preparation of the cleaning roll 5 except that the spiral angle θ for winding the strip with the double-sided tape around the core is set to be 15°.

Comparative Example 3

[Cleaning Roll 8]

A cleaning roll 8 is obtained in the same manner as in the preparation of the cleaning roll 4 except that a foamed urethane sheet (EZQ-S produced by INOAC CORPORATION) is used.

Comparative Example 4

[Cleaning Roll 9]

A cleaning roll 9 is obtained in the same manner as in the preparation of the cleaning roll 1 except that a foamed urethane sheet (EP-70 produced by INOAC CORPORATION) having a thickness of 3.0 mm and a width of 4 mm is used.

[Surface Condition of Elastic Layer]

The line roughness RaE of the protruding portion formed at the end portion of the elastic layer in the width direction and the line roughness RaV of the center portion of the elastic layer in the width direction are measured by the above-described method and then, RaE/RaV is calculated. The width W of the nodal section of the foam cell wall surface is measured by the above-described method.

[Evaluation of Clean Ability]

A drum cartridge of an image forming apparatus "DOCUCENTER-VI C7771 manufactured by Fuji Xerox Co., Ltd." is mounted so as to be in contact with the cleaning roll indicated in Table 1 and the prepared charging roll 1. Next, after printing 20,000 sheets of band-shaped image quality patterns having a length of 320 mm and a width of 30 mm in an output direction on A3 recording paper with 100% image density under an environment of 32° C. and 85% RH, and the surface condition at the image quality pattern printing position of the charging roll 1 is observed so as to perform the evaluation of the clean ability of the deposit. Furthermore, after printing an additional 50,000 sheets of the same image quality pattern (a total of 70,000 sheets of printing) under an environment of 10° C. and 15% RH using the same cleaning roll and charging roll, and similarly, the surface condition is observed so as to perform the evaluation of the clean ability of the deposit. The observation of the charging roll is performed by directly observing the surface using a confocal laser microscope (OLS 1100, manufactured by OLYMPAS), and the clean ability is evaluated based on the following criteria.

—Evaluation of Clean Ability: Criteria—

G0: Deposit on surface of charging roll is observed 10% or less per 1 $\mu m^2$.

G0.5: Deposit on surface of charging roll is observed more than 10% to 20% or less per 1 $\mu m^2$.

G1: Deposit on surface of charging roll is observed more than 20% to 30% or less per 1 $\mu m^2$.

G2: Deposit on surface of charging roll is observed more than 30% to 40% or less per 1 $\mu m^2$ G3: Deposit on surface of charging roll is observed more than 40% to 50% or less per 1 $\mu m^2$.

TABLE 4

| | | | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|---|---|
| Cleaning body (elastic layer) | Cleaning roll No. | | 1 | 2 | 3 | 4 | 5 | 6 | 7 | 8 | 9 |
| | Line roughness at edge (RaV) | (μm) | 65 | 74 | 88 | 99 | 52 | 37 | 31 | 25 | 28 |
| | Line roughness at recess (RaV) | (μm) | 10 | 10 | 10 | 7 | 10 | 8 | 8 | 8 | |
| | RaE/RaV | | 6.5 | 7.4 | 8.8 | 14.1 | 5.2 | 4.6 | 3.9 | 3.1 | 3.5 |
| | Number of cells | Cell/25 mm | 90 | 90 | 90 | 90 | 60 | 60 | 60 | 30 | 70 |
| | Spiral angle | (°) | 15 | 30 | 45 | 45 | 45 | 30 | 15 | 45 | 15 |
| | Width W of nodal section on foam cell wall surface | (μm) | 42 | 42 | 42 | 42 | 84 | 84 | 84 | 120 | 89 |
| Evaluation | Clean ability (after printing 70,000 sheets) | | G0 | G0 | G0 | G0 | G0.5 | G1 | G2 | G3 | G2 |

From the above evaluation results, it may be understood that the examples have excellent clean ability (that is, cleaning performance) evaluation as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning body comprising:

a shaft; and an elastic layer that is spirally wound around an outer circumferential surface of the shaft from one end to the other end of the shaft, wherein a relationship between line roughness of a protruding portion formed at an end portion of the elastic layer in a width direction (RaE) and line roughness of a center portion of the elastic layer in the width direction (RaV) satisfies 5≤RaE/RaV.

2. The cleaning body according to claim 1, wherein the relationship between RaE and RaV satisfies 6≤RaE/RaV.

3. The cleaning body according to claim 2, wherein the relationship between RaE and RaV satisfies 7≤RaE/RaV.

4. The cleaning body according to claim 1, wherein, with respect to the elastic layer, number of cells is from 80 cells/25 mm to 105 cells/25 mm, and a spiral angle is from 15° to 65°.

5. The cleaning body according to claim 4, wherein, with respect to the elastic layer, number of cells is from 85 cells/25 mm to 100 cells/25 mm, and the spiral angle is from 25° to 45°.

6. A cleaning device comprising:

a body; and a cleaning body comprising:

a shaft; and an elastic layer that is spirally wound around an outer circumferential surface of the shaft from one end to the other end of the shaft, wherein a relationship between line roughness of a protruding portion formed at an end portion of the elastic layer in a width direction (RaE) and line roughness of a center portion of the elastic layer in the width direction (RaV) satisfies 5≤RaE/RaV, and wherein the cleaning body is configured to clean the body while rotating in a state of being in contact with the body which rotates.

7. An image forming apparatus comprising:

an image holding member configured to hold an image;

a rotatable charging body that configured to charge the image holding member;

an exposure device configured to expose the image holding member charged by the charging body to form an electrostatic latent image;

a developing device configured to develop an electrostatic latent image formed on the image holding member by the exposure device; and a cleaning body comprising:

a shaft; and an elastic layer that is spirally wound around an outer circumferential surface of the shaft from one end to the other end of the shaft, wherein a relationship between line roughness of a protruding portion formed at an end portion of the elastic layer in a width direction (RaE) and line roughness of a center portion of the elastic layer in the width direction (RaV) satisfies 5≤RaE/RaV, and wherein the cleaning body is configured to clean the charging body while rotating in a state of being in contact with the charging body which rotates.

* * * * *